US008246162B2

(12) United States Patent
Takatsuka

(10) Patent No.: US 8,246,162 B2
(45) Date of Patent: Aug. 21, 2012

(54) TRANSPORTING DEVICE AND LIQUID EJECTING APPARATUS

(75) Inventor: Tsutomu Takatsuka, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 242 days.

(21) Appl. No.: 12/656,887

(22) Filed: Feb. 18, 2010

(65) Prior Publication Data

US 2010/0225719 A1 Sep. 9, 2010

(30) Foreign Application Priority Data

Mar. 4, 2009 (JP) ..... 2009-050877

(51) Int. Cl.
*B41J 2/01* (2006.01)

(52) U.S. Cl. ..... 347/104; 347/101

(58) Field of Classification Search ..... 347/101, 347/104

See application file for complete search history.

(56) References Cited

U.S. PATENT DOCUMENTS 4,547,786 A * 10/1985 Logan et al. ..... 347/43
6,964,468 B2 * 11/2005 Kitahara et al. ..... 347/42
7,887,178 B2 * 2/2011 Moon ..... 347/104
2003/0132996 A1 * 7/2003 Adachi ..... 347/102
2004/0233265 A1 * 11/2004 Kojima et al. ..... 347/102
2005/0128276 A1 * 6/2005 Yamada ..... 347/104
2006/0262175 A1 * 11/2006 Miura ..... 347/102
2007/0247508 A1 * 10/2007 Miura ..... 347/102
2009/0295060 A1 * 12/2009 Kakimoto et al. ..... 271/3.14
2010/0265308 A1 * 10/2010 Lin et al. ..... 347/104

FOREIGN PATENT DOCUMENTS

JP 2008-221764 9/2008

* cited by examiner

*Primary Examiner* — Stephen Meier
*Assistant Examiner* — Leonard S Liang
(74) *Attorney, Agent, or Firm* — Jean C. Edwards, Esq.; Edwards Neils PLLC

(57) ABSTRACT

The transporting device includes a linear guide member disposed at a position facing to inkjet line heads and a drying device, moving a pallet on which a sheet is attracted by magnetic force, and a belt driving device supporting both sides of the pallet by an endless belt and driving the pallet by circumferential movement of the belt. An ink is ejected from the inkjet line heads to the sheet on the pallet transported by the linear guide member, and a recording surface of the sheet is dried by the drying device. Subsequently, the pallet from which the sheet is separated is moved back to an upstream side of the inkjet line heads passing through a lower side of the linear guide member in the vertical direction by circumferential movement of the belt.

14 Claims, 4 Drawing Sheets

TRANSPORTING DEVICE AND LIQUID EJECTING APPARATUS

CROSS-REFERENCE TO RELATED APPLICATION

This application claims priority under 35 USC 119 from Japanese Patent Application No. 2009-050877 filed Mar. 4, 2009, the disclosure of which is incorporated by reference herein.

BACKGROUND OF THE INVENTION

1. Technical Field

The present invention relates to a transporting device that transports a recording medium, and a liquid ejecting apparatus equipped with the transporting device.

2. Related Art

Conventionally in an inkjet recording apparatus, a transporting device in which a recording medium (a material to be printed, such as a sheet) is made to be absorbed on an endless belt and is transported to a position facing to a liquid ejecting head is known.

Further, Japanese Patent Application Laid-Open (JP-A) No. 2008-221764 (patent document 1) discloses an apparatus in which an inverted L-shaped first holding pallet that is capable of attracting a recording medium thereon and an inverted L-shaped second holding pallet that is formed so as to be symmetrical to the first holding pallet are moved by a linear motor, and for example, during a period in which a liquid is ejected from a liquid ejecting head onto the recording medium which on the first holding pallet, the second holding pallet is moved by the linear motor below the first holding pallet and is moved to return to an upstream side of the liquid ejecting head in a direction in which the recording medium is transported. Further, the above-described patent document 1 also discloses an apparatus in which plural holding pallets which are capable of holding a circular recording medium are moved in parallel to and in a horizontal direction with respect to the surface of the liquid ejecting head from which a liquid is ejected, whereby the holding pallets are moved to return to the original position.

In the above-described patent document 1, transport accuracy of the recording medium can be improved by using the linear motor compared with a case in which an endless belt is used. However, the linear motor is used even when the first holding pallet and the second holding pallet are moved to return to the upstream side of the liquid ejecting head, and therefore, the cost of such apparatuses becomes higher. Further, when the number of holding pallets is increased so as to achieve high-speed processing and the holding pallets are moved in the horizontal direction, the widthwise dimension of the apparatus becomes larger.

SUMMARY OF THE INVENTION

In view of the above-described circumstances, the present invention provides a transporting device and a liquid ejecting apparatus which can form a high quality image by securing transport accuracy of a recording medium and whose widthwise dimension is small with low cost.

A transporting device according to a first aspect of the present invention includes: a pallet that transports a recording medium while attracting the recording medium thereto; a pallet transporting section provided at a position facing a liquid ejecting head which ejects a liquid onto the recording medium, and that transports and drives the pallet by means of magnetic force along the pallet transporting section; and a belt driving section that supports the pallet with a belt member, and moves the pallet from a downstream side of the liquid ejecting head in a direction in which the recording medium is transported, to an upstream side in the direction in which the recording medium is transported, via a lower side, in a vertical direction, of the pallet transporting section.

According to the first aspect of the present invention, the pallet transporting section is provided at the position facing to the liquid ejecting head that ejects the liquid to the recording medium. The pallet attracting (and holding) the recording medium is transported and driven by magnetic force along the pallet transporting section and is transported to the position facing to the liquid ejecting head. Then, the liquid is ejected from the liquid ejecting head to the recording medium attracted onto the pallet. Further, the belt driving section which supports and moves the pallet by the belt member is provided, and the pallet is moved by the belt member from the downstream side of the liquid ejecting head in the recording medium transporting direction to the upstream side of the liquid ejecting head in the recording medium transporting direction passing through the lower side of the pallet transporting section in the vertical direction. The pallet is transported and driven along the pallet transporting section by the pallet transporting section at the position facing to the liquid ejecting head, therefore the transport accuracy of the recording medium improves. At the same time, the belt driving section is used when the pallet is moved to return to the upstream side of the liquid ejecting head in the recording medium transporting direction, therefore reduction in the cost of the device becomes possible. Further, when the pallet is moved to return to the upstream side of the liquid ejecting head in the recording medium transporting direction, it is moved via (passing through) the lower side of the pallet transporting section in the vertical direction, thereby making it possible to prevent the widthwise dimension of the device from becoming larger.

In a second aspect of the present invention in the transporting device according to the first aspect of the present invention, when the pallet is transported at the position facing the liquid ejecting head, a speed at which the pallet is transported by the pallet transporting section is set to be faster than a speed at which the pallet is transported by the belt driving section.

According to the second aspect of the present invention, when the pallet is transported at the position facing the liquid ejecting head, the speed of which the pallet is transported by the pallet transporting section is set to be higher than the speed of which the pallet is transported by the belt driving section, whereby the recording medium is transported based on the speed of which the pallet is transported by the pallet transporting section. As a result, the transport accuracy of the recording medium at the position facing to the liquid ejecting head improves and an image of high quality can be obtained.

In a third aspect of the present invention in the transporting device according to the first aspect or the second aspect, the pallet includes suction holes that suction the recording medium to the pallet, and the pallet transporting section includes a negative pressure section that imparts suction force to the suction holes.

In a fourth aspect of the present invention in the transporting device according to the third aspect, the pallet transporting section further includes a suction force adjusting section that adjusts negative pressure at the negative pressure section.

According to the third aspect and the fourth aspect of the present invention, the pallet includes the suction holes to which the recording medium is sucked in, and the negative pressure of the negative pressure section that imparts suction force to the suction holes is adjusted by the suction force adjusting section provided in the pallet transporting section, and the force of sucking of the recording medium to the pallet is adjusted. As a result, the force of suction by the pallet can be adjusted depending on the thickness, kind or the like of the recording medium.

In a fifth aspect of the present invention in the transporting device according to the first aspect, a guided portion is provided at the pallet, and a guiding portion which can be inserted in the guided portion is provided at the pallet transporting section so as to extend in the recording medium transporting direction.

A liquid ejecting apparatus according to the sixth aspect of the present invention includes a liquid ejecting head that ejects a liquid to a recording medium, and the transporting device according to any one of the first to the fifth aspects, wherein an image is formed by the recording medium attracted to the pallet being passed through a position facing the liquid ejecting head.

According to the sixth aspect of the present invention, the transporting device in any one of the first to the fifth aspects is provided, and the image is formed by causing the recoding medium attracted onto the pallet to pass through the position facing the liquid ejecting head. As a result, the pallet is transported and driven along the pallet transporting section the pallet transporting section at the position facing the liquid ejecting head, whereby the transport accuracy of the recording medium improves. Further, the belt driving section is used when the pallet is moved to return from the downstream side of the liquid ejecting head in the recording medium transporting direction to the upstream side in the recording medium transporting direction, thereby allowing reduction in the cost of the device. Moreover, the pallet is moved passing through the lower side of the pallet transporting section in the vertical direction when it is moved to return to the upstream side of the liquid ejecting head in the recording medium transporting direction, thereby making it possible to inhibit the widthwise dimension of the device from becoming larger.

In a seventh aspect of the present invention in the liquid ejecting apparatus of the sixth aspect, further include a drying section provided at the downstream side of the liquid ejecting head in the recording medium transporting direction, that dries an image surface at which the liquid is ejected to the recording medium without contact the recording medium; and a heating and fixing section provided at a downstream side of the drying section in the recording medium transporting direction, that fixes the image surface of the recording medium by applying heat thereto.

According to the seventh aspect of the present invention, the drying section is provided at the downstream side of the liquid ejecting head in the recording medium transporting direction, and the heating and fixing section is provided at the downstream side of the drying section in the recording medium transporting direction. The image surface formed by the liquid being ejected to the recording medium is dried by the drying section in a non-contact manner, and the image surface of the recording medium is fixed by applying heat. Due to the image surface of the recording medium being dried in a non-contact manner, deterioration in the image quality is prevented or suppressed, and an image of high quality is obtained accordingly.

In an eighth aspect of the present invention in the liquid ejecting apparatus of the sixth aspect, the recording medium is a print paper having air permeability of not less than 1000 seconds and a surface roughness in the range of 0.2 to 4.0 μm in terms of a centerline average roughness (Ra), and the liquid is an aqueous ink including an aqueous dispersion of a colored resin fine particle in which a pigment particle is covered by a film-forming resin.

According to the eighth aspect of the present invention, the above-described print paper is used as the recording medium and the above-described water color ink is used as the liquid, to form the image surface on the recording medium, and to dry and heat and fix the image surface on the recording medium, whereby an image having a much higher image quality, abrasion resistance and glossiness is obtained.

In a ninth aspect of the present invention in the liquid ejecting apparatus of the sixth aspect, when the pallet is transported at the position facing the liquid ejecting head, a speed at which the pallet is transported by the pallet transporting section is set to be faster than a speed at which the pallet is transported by the belt driving section.

In a tenth aspect of the present invention in the liquid ejecting apparatus of the seventh aspect, the pallet transporting section is provided at a position facing the liquid ejecting head and the drying section.

According to the present invention, the transporting device and the liquid ejecting apparatus, which make it possible to form an image of high quality by securing transport accuracy of the recording medium and reduce the costs of the device and apparatus and whose widthwise dimension is small, can be realized.

BRIEF DESCRIPTION OF THE DRAWINGS

An embodiment of the invention will be described in detail with reference to the following figures, wherein.

DETAILED DESCRIPTION OF THE INVENTION

An image forming apparatus serving as a liquid ejecting apparatus equipped with a transporting device according to an embodiment of the present invention is described hereinafter.

First, an overall structure of an image forming apparatus 10 is described.

[Image Forming Apparatus]

Figure 1:
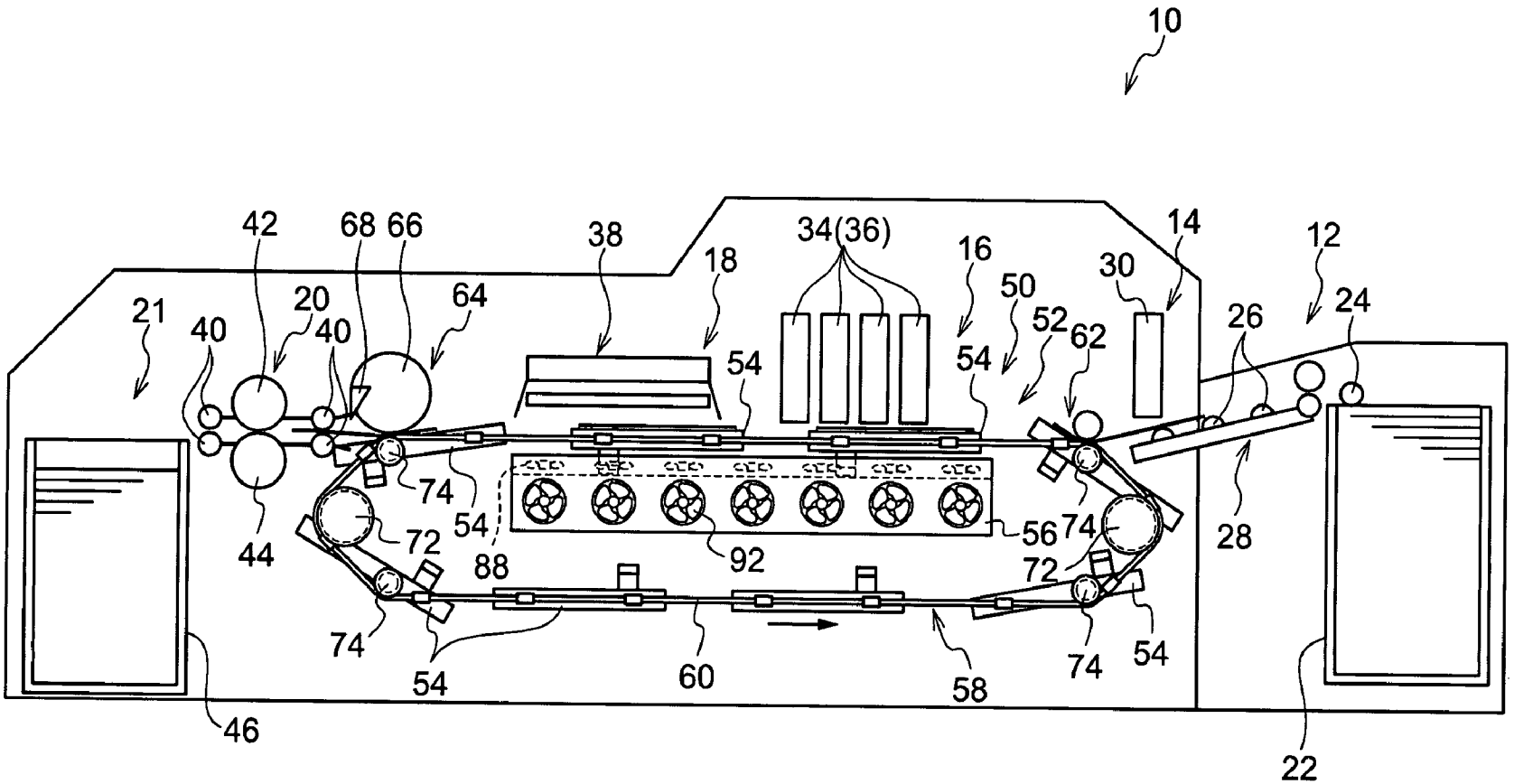
FIG. 1 is an overall structural diagram showing the structure of an image forming apparatus equipped with a transporting device according to an embodiment of the present invention.

As shown in FIG. 1, the image forming apparatus 10 according to the present embodiment is equipped with a paper feeding transporting section 12 at an upstream side in a direction of transporting of a sheet of paper (hereinafter referred to as "sheet"), which feeds and transports the sheet. Provided along the direction of transporting a sheet at the downstream side of the paper feeding transporting portion 12 are: a processing liquid applying section 14 that applies a processing liquid to a recording surface of the sheet; an image forming section 16 that forms an image on the recoding surface of the sheet; an ink drying section 18 that dries the image formed on the recording surface; an image fixing section 20 that causes the dried image to be fixed on the sheet; and a discharge section 21 that discharges the sheet with the image being fixed thereon. Further, the image forming apparatus 10 is also equipped with a sheet transporting section 50 at a position facing to the image forming section 16 and the ink drying section 18, which sheet transporting section transports the sheet while attracting (adhering) the sheet to a pallet 54.

Respective processing sections are described hereinafter.

(Sheet Feeding Transporting Section)

The sheet transporting section 12 is provided with a stacking section 22 in which sheets are stacked, and a paper feeding section 24 is provided at a downstream side of the stacking section 22 in the sheet transporting direction ("the sheet transporting direction" occasionally may be omitted hereinafter). The paper feeding section 24 is provided so as to feed sheets stacked in the stacking section 22 one by one. The sheet fed by the paper feeding section 24 is transported on a transporting section 28 having plural rollers 26 and is further transported to the processing liquid applying section 14.

(Processing Liquid Applying Section)

In the processing liquid applying section 14, a processing liquid applying device 30 is disposed in a direction orthogonal to the sheet transporting direction, and a processing liquid is applied to a recording surface of the sheet by the processing liquid being ejected from the processing liquid applying device 30. Here, the processing liquid reacts with an ink to cause aggregation of color material (pigment), and has an effect of accelerating separation of the color material (pigment) and a solvent from each other, thereby preventing mixing of ink colors. Incidentally, in the present embodiment, although the processing liquid applying device 30 that ejects the processing liquid is provided, a structure in which a processing liquid is supplied to an application roller, and the application roller and a sheet are made to come into contact with each other, thereby causing the processing liquid to be transferred and applied to a recording surface of the sheet may also be used.

It is ideal that the film thickness of the processing liquid is sufficiently smaller than a liquid droplet of an ejected liquid from an ink ejecting head. For example, in a case where an amount of the ejected droplet is 2 pl, the average diameter of the liquid droplet of the ejected droplet from the head is 15.6 μm, and when the film thickness of the processing liquid is large, the ink dot floats within the processing liquid without coming into contact with the recoding surface of the sheet. It is preferable that the film thickness of the processing liquid is not more than 3 μm so as to obtain the diameter of a landed dot of 30 μm or greater by the amount of the ejected droplet of 2 pl.

In such a manner as described above, the sheet having the recording surface to which the processing liquid is applied in the processing liquid applying section 14 is transported to a sheet transporting section 50.

(Sheet Transporting Section)

In the sheet transporting section 50, a transporting device 52 equipped with plural pallets 54 that transport the sheet while attracting the sheet thereto (holding the sheet thereon) is disposed. The transporting device 52 is disposed at a position that faces to the image forming section 16 and the ink drying section 18. Further, the transporting device 52 includes a linear guide member 56 and a belt driving device 58. The linear guide member 56, serving as a pallet transporting member, attracts the sheet to the pallet 54 and moves the pallets 54 by means of magnetic force. The belt driving device 58, serving as a belt driving section, supports both sides of each of the pallets 54 by an endless belt 60 and drives the pallets 54 by circumferential movement of the belt 60. The sheet transporting section 50 is provided with a sheet supplying section 62 that supplies the sheet to the pallet 54 between the processing liquid applying section 14 and the image forming section 16, and a sheet separating section 64 in which a sheet is separated from the pallet 54 between the ink drying section 18 and the image fixing section 20. The transporting device 52 is described later in detail.

(Image Forming Section)

A head unit 36 configured by ink jet line heads 34 serving as liquid ejecting heads of a single path system is disposed at the upper side of the linear guide member 56 at a position that faces closely to a sheet transported by the pallet 54 with being attracted on the pallet 54. In the head unit 36, at least the ink jet line heads 34 of Y, M, C, K that are the fundamental colors are arranged in the sheet transporting direction, and images of these colors are formed on the processing liquid layer that is formed on the recording surface of the sheet in the processing liquid applying section 14. The ink jet line heads 34 each have a length corresponding to the maximum sheet width of the sheet to be processed by the image forming apparatus 10, and plural rows of nozzles for ejecting ink are arranged on the nozzle surface of the ink jet line head over a length that exceeds at least one side of a maximum size sheet (i.e., the entire width of a range in which an image can be drawn).

The processing liquid exhibits effect of causing aggregation of latex particle and color material (pigment) dispersed in the ink, and forms agglomerate so that color material degradation does not occurs on the sheet. An example of reaction of the ink and the processing liquid is as follows: the processing liquid includes an acid, and pigment dispersion is broken down due to lowering of a pH value, and bleeding of color material, color mixing of respective color inks, and the ejected droplets interference caused by liquid-composite at the time of landing of ink droplets are avoided by using an agglomeration mechanism.

Incidentally, the head unit 36 can retreat (withdraw) from the upper side of the linear guide member 56, and maintenance operations such as cleaning of the nozzle surfaces of the ink jet line heads 34, discharging of viscosity ink and the like is carried out by causing the head unit 36 to retreat from the upper side of the linear guide member 56.

The sheet with an image being formed on a recording surface thereof is transported to the ink drying section 18 by movement of the pallets 54.

(Ink Drying Section)

In the ink drying section 18, a drying device 38 is provided at the upper side of the linear guide member 56 and along the sheet transporting direction, the drying device 38 dries the recording surface of the sheet in a non-contact manner. The drying device 38 is equipped with nozzles that blow hot air on the recording surface of the sheet. In the image forming region of the sheet, solvent separated by the color material agglomeration action is dried by hot air, and an image layer in the form of a thin film is formed. Incidentally, in place of the hot air nozzles blowing hot air, an IR heater may be provided, or a combination of the hot air nozzles and the IR heater may be used.

The temperature of the hot air varies depending on the transport speed of the sheet. For example, due to the temperature of the hot air being set in the range of 50° C. to 70° C., the temperature of the IR heater being set in the range of 200° C. to 600° C., the ink surface temperature is set in the range of 50° C. to 60° C. The vaporized solvent is exhausted outside of the image forming apparatus 10 together with air, but the solvent may also be recovered as a liquid by being cooled by a cooler/radiator or the like.

The sheet separating section 64 includes a separating roller 66 equipped with a separating claw 68 that separates the sheet that is attracted on the pallet 54. The sheet with an image on the recording surface being dried is separated from the pallet 54 in the sheet separating section 64 and is transported to the image fixing section 20 by rotation of a pair of conveying rollers 40.

(Image Fixing Section)

The image fixing section 20 is provided with a heating roller 42 and a pressure applying roller 44 made to press-abut against the heating roller, which rollers are made rotatable. In the image fixing section 20, latex particles in the image layer on the sheet dried by the drying device 38 are melted by being heated and pressurized, and fixed and fused on the sheet.

The heating roller 42 has the structure of a halogen lamp being built-in in a metal pipe made from aluminum or the like having a high heat conductivity, and heat energy having a Tg temperature or higher of the latex is imparted by the heating roller 42. This makes it possible to melt the latex particles and push-in them in irregularities on the sheet so that the fixing is carried out and also to obtain glossiness by leveling the irregularities of the image surface. The pressure applying roller 44 is disposed in the state of abutting by pressure against the surface of the heating roller 42, and is provided so as to obtain nipping force between the heating roller 42 and the pressure applying roller. For this reason, the pressure applying roller 44 is structured so as to have an elastic layer on the surface thereof and have a uniform nip width with respect to the sheet. Incidentally, the distance between the heating roller 42 and the pressure applying roller 44 is provided in a changeable manner (the heating roller 42 and the pressure applying roller 44 are relatively movable) in correspondence to the thickness of the sheet. By the distance between the heating roller 42 and the pressure applying roller 44 being changed (moved) depending on the thickness of the sheet, abrasion resistance (image strength) of a fixed image improves.

The sheet with an image on the recording surface being fixed by the above-described process is transported by rotation of the pair of transporting rollers 40 toward the discharge section 21 provided at the downstream side of the image fixing section 20, and such sheets are sequentially stacked in the stacking section 46.

In the present embodiment, the image fixing section 20 is described by way of example. It suffices that an image formed on a recording surface can be dried and fixed in the ink drying section 18, and therefore, the image fixing section 20 is not necessarily required.

Next, the transporting device 52 according to an embodiment of the present invention is described.

Two large-diameter rollers 72 and small-diameter rollers 74 are provided at both sides of the belt driving device 58 that forms the transporting device 52. The two large-diameter rollers 72 are disposed at the upstream and downstream sides of the sheet transporting direction, respectively, and the small-diameter rollers 72 are disposed respectively at upper and lower sides of each of the large-diameter roller 72. An endless belt 60 is wound over these rollers 72 and rollers 74. By the large-diameter roller 72 disposed at the upstream side in the sheet transporting direction being driven, the endless belt 60 moves around these rollers in a counterclockwise manner in FIG. 1.

Figure 2:
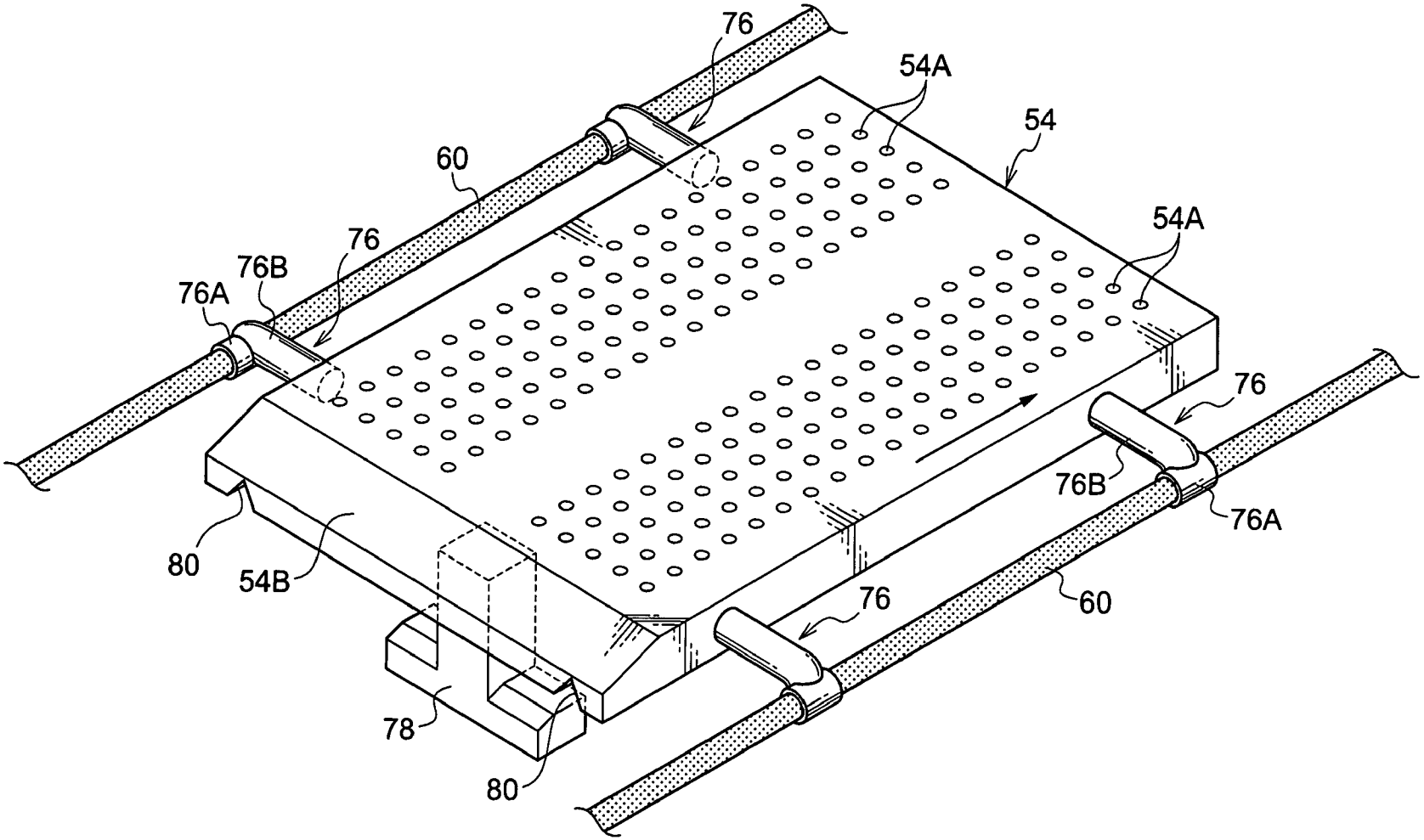
FIG. 2 is a perspective view showing a pallet used in the transporting device according to the embodiment of the present invention.

As shown in FIG. 2, the pallet 54 is provided with four supporting portions 76. The supporting portions 76 are disposed at front portions and rear portions at respective both side portions of the pallet 54 such that the supporting portions 76 support the pallet 54 at the both side portions on the endless belt 60 (that is, the pallet 54 is supported on the endless belt 60). The supporting portion 76 is formed by a cylindrical (tube shaped) portion 76A through which the belt 60 passes and which is fixed, and a rod-shaped portion 76B fixed to the cylindrical portion 76A and fitted with the side portion of the pallet 54 in a rotatable manner. By the belt 60 being moved circumferentially in a counterclockwise manner (indicated by arrow) in FIG. 1, the pallet 54 supported by the belt 60 moves. Due to the rod-shaped portions 76B being engaged with the side portions of the pallet 54 in a rotatable manner, the pallet 54 moves smoothly during circumferential movement of the belt 60. Incidentally, a structure in which the rod-shaped portions 76B are fixed to the side portions of the pallet 54 and the rod-shaped portions 76B and the cylindrical portions 76A are made rotatable may be used. Further, it is preferable that these supporting portions 76 are provided in at least four positions, i.e., the front and rear positions respectively at the both side portions of the pallet 54. Moreover, a structure in which the cylindrical portions 76A provided at the rear side of the pallet 54 in the transporting direction are not fixed to the belt 60 but are configured to slide on the belt 60 may also be used. In other words, only the cylindrical portions 76A at the front side of the pallet 54 in the transporting direction are fixed to the belt 60, whereby movement of the pallet 54 at the rollers 72, 74 becomes smoother.

The pallet 54 includes plural suction holes 54A formed therein so as to extend in the thickness direction of the plate-shaped member, and by the sheet being sucked in (suctioned) by the plural suction holes 54A, the sheet is attracted (adhered) and held to the upper surface of the pallet 54. In the present embodiment, the plural suction holes 54A are formed at both sides in the widthwise direction of the pallet 54 (in a direction orthogonal to the sheet transporting direction), and are not formed at an intermediate portion in the widthwise direction of the pallet 54. A tapered portion 54B is provided at the front end portion of the pallet 54 in the sheet transporting direction and is declined toward the front side. A space is formed between the tapered portion 54B and the leading end of the sheet, whereby separating of the sheet becomes facilitated. Further, a chuck claw (not shown in the drawings) is provided in the pallet 54 so as to press down the leading end of the sheet, whereby the positioning accuracy of the sheet on the pallet 54 is improved.

Figure 3:
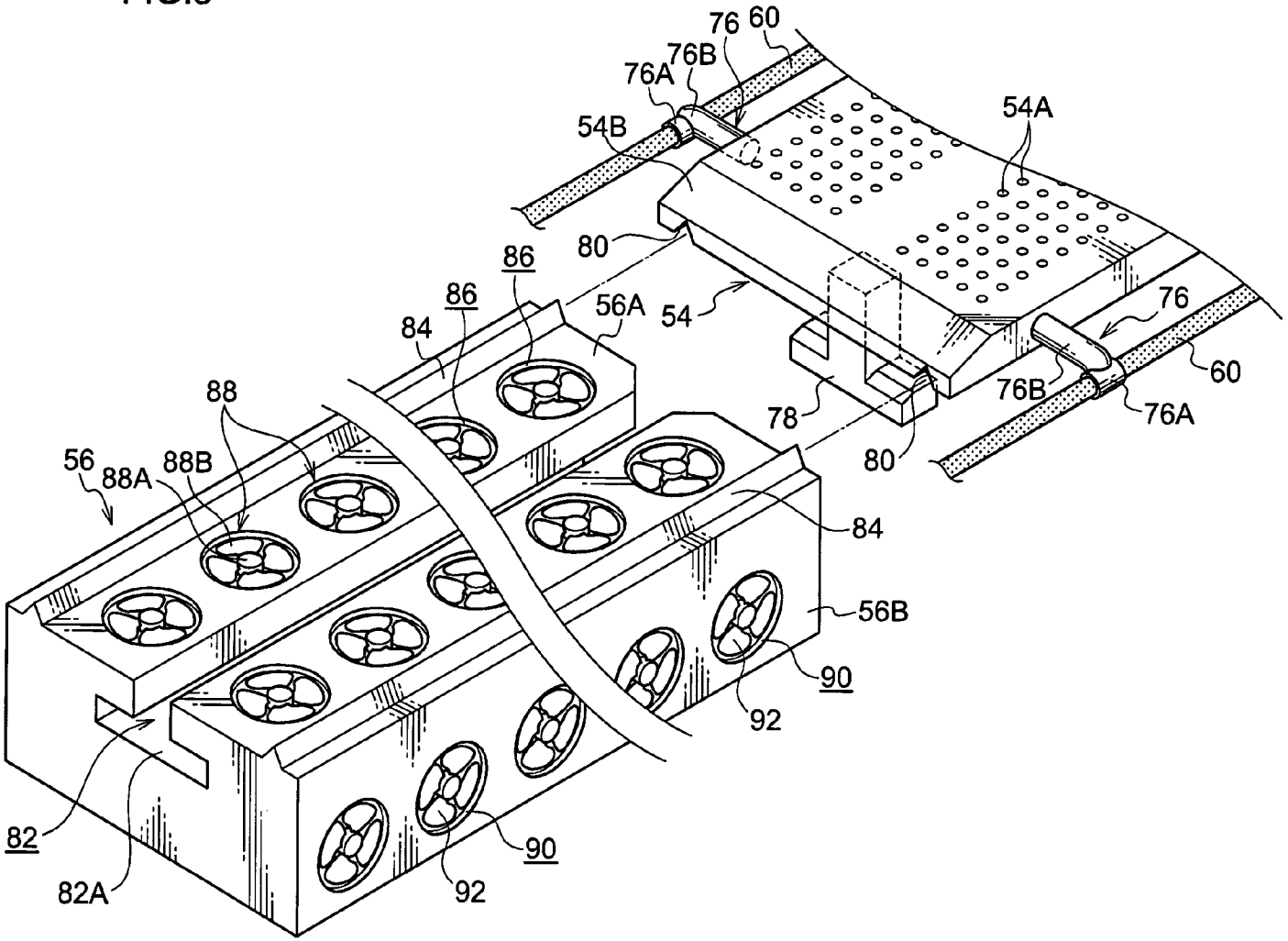
FIG. 3 is a perspective view showing a linear guide member used in the transporting device of the present invention.

A substantially inverted T-shaped holding portion 78 is provided at the lower portion of the pallet 54 at the front end portion of the pallet 54 in the sheet transporting direction. As shown in FIG. 3, the linear guide member 56 includes a substantially inverted T-shaped guide hole 82, which is slightly larger than the outer shape of the holding portion 78, so as to extend along the sheet transporting direction, so that the holding portion 78 (the pallet 54) can be moved along the guide hole 82 in the state of the holding portion 78 being inserted in the guide hole 82. The holding portion 78 includes a permanent magnet, and a linear electromagnetic coil portion is provided in the lower surface portion 82A of the guide hole 82 of the linear guide member 56. The positions of the S pole and N pole of the linear electromagnetic coil portion are changed along the sheet transporting direction, thereby causing the holding portion 78 to move by magnetic force in the sheet transporting direction, so as to transport the pallet 54. By the pallet 54 being transported by means of magnetic force using the linear guide member 56, the transporting accuracy of the pallet 54 is improved and the precision of ink landed positions on the sheet also is improved.

Guide projections 84 are provided respectively at both sides of the upper surface portion 56A of the linear guide member 56 along the sheet transporting direction. The guide projection 84 is formed so as to have a substantially triangular cross section which cross section is orthogonal to the sheet transporting direction, and guide grooves 80 are provided on the lower surface of the pallet 54 so as to engage with the corresponding guide projections 84. Due to the pallet 54 moving along the sheet transporting direction in the state in which the guide grooves 80 are engaged with the guide projections 84 of the linear guide member 56, respectively, shaky movement of the pallet 54 in the widthwise direction is prevented and the precision of ink landed positions on the sheet improves.

Plural circular opening portions 86 are formed on the upper surface portion 56A of the linear guide member 56, and a fan 88 serving as a negative pressure member is provided in each of the opening portions 86 and suctions (sucks in) the sheet from the plural suction holes 54A of the pallet 54. The plural suction holes 54A of the pallet 54 moving above the fans 88 are each brought into a negative pressure state by rotation of the fans 88, so as to suck in the sheet from the plural suction holes 54A of the pallet 54. The fan 88 includes a rotating shaft 88A and plural blade portions 88B provided around the rotating shaft 88A, and a motor (not shown in the drawings) serving as a sucking force adjusting member which can vary the rotational speed is connected to the rotating shaft 88A. By the rotational speeds of the plural fans 88 being respectively varied, a sheet suck amount by which the sheet is sucked in from the plural suction holes 54A of the pallet 54 is adjusted. In other words, by the rotational speeds of the fans 88 being increased, the sucking force of the sheet from the plural suction holes 54A of the pallet 54 can be made stronger. For example, the sucking force can be adjusted depending on the thickness or hardness of a recording medium such as the sheet. Further, plural circular opening portions 90 are formed in the side surface portion 56B of the linear guide member 56, and an exhaust fan 92 is provided in each of the opening portions 90 so as to exhaust air sucked in by rotation of the fans 88.

Incidentally, a shutter (not shown in the drawings) which is capable of changing an open area of the opening portion 86 in which the fan 88 is disposed is provided as the sucking force adjusting member, so that the sheet suck amount by which the sheet is sucked in from the plural suction holes 54A of the pallet 54 may also be adjusted by changing the open area of each of the opening portions 86. Further, the sheet suck amount by which the sheet is sucked in from the plural suction holes 54A of the pallet 54 may also be adjusted by changing the angle of the blade portions 88B of the fan 88.

Further, due to the sheet being sucked in to the pallet 54 and transported by using the linear guide member 56, the degree of freedom in the thickness and hardness of the sheet improves. For this reason, in place of the sheet, a glass substrate or the like can also be transported. Moreover, due to a structure in which the inkjet line heads 34 being moved close to or apart from the surface of the pallet 54, the distance between the inkjet line heads 34 and the pallet 54 can be varied depending on the thickness of the sheet.

Figure 4:
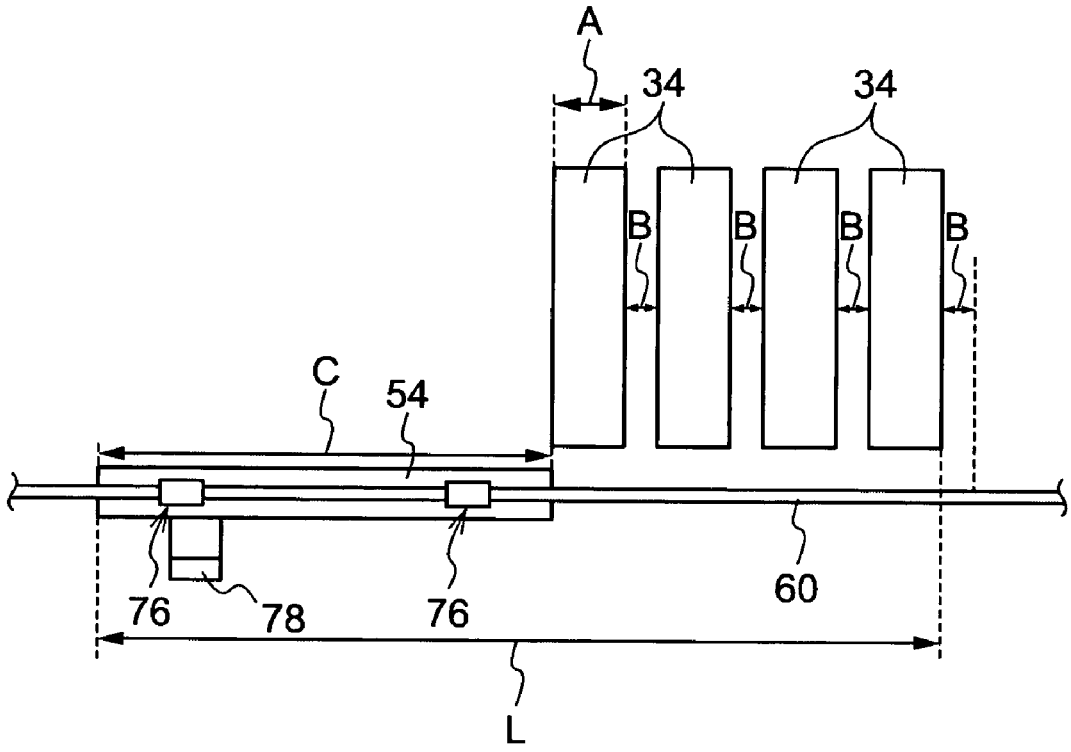
FIG. 4 is a side view showing an overall length of the linear guide member.

As shown in FIG. 4, the longitudinal dimension (length) L of the linear guide member 56 (the length in the transporting direction) is set so as to satisfy the following relationship.

$L \geqq$(length $A$ of head 34+distance $B$ between heads 34)×number of heads 34−(distance $B$ between heads 34)+(length $C$ of pallet 54)

By the longitudinal dimension L of the linear guide member 56 being set so as to satisfy the above-described relationship, it is possible that the pallet 54 is moved by the linear guide member 56 such that the transport speed of the sheet is maintained substantially at a constant value until the trailing end potion of the sheet on the pallet 54 has passed the inkjet line heads 34 during ejecting of inks from the inkjet line heads 34. As a result, it is possible to prevent change in the transport speed of the sheet on the pallet 54 during ejecting of inks from the inkjet line heads 34 and realize a high quality image.

In the present embodiment, the holding portion 78 is provided at the front end portion of the pallet 54 in the transporting direction. However, it becomes unnecessary that the overall length of the pallet 54 is added to the longitudinal dimension (length) L of the linear guide member 56, by the holding portion being provided over the overall length of the pallet 54 in the transporting direction, so the linear guide member 56 can be made smaller.

Further, when the sheet is attracted by suction onto the pallet 54, preferably, the sheet is sucked in sequentially from the downstream side to the upstream side in the sheet transporting direction by controlling rotation of the plural fans 88. As a result, the sheet can be attracted evenly without causing deflection of the sheet on the pallet 54.

Moreover, the transport speed of the pallet 54 by the linear guide member 56 is set to be slightly faster (higher) than the transport speed of the pallet 54 by the belt driving device 58. As a result, the transport speed of the pallet 54 at a position facing the inkjet line heads 34 can be set based on the transport speed of the pallet by the linear guide member (i.e., the linear guide member 56 is used for rate (speed) controlling (determining)).

By the pallet 54 being transported by the linear guide member 56 to the position facing the ink drying section 18, the recording surface of the sheet on the pallet 54 is dried. In this case, before the recording surface of the sheet is dried, the recording surface can be transported to the drying device 38 in a non-contact manner. Further, in consideration of drying efficiency of the ink drying section 18, hot air is preferred. Due to the recording surface being dried in the state in which the sheet is sucked in on the pallet 54, bending (deflection) or deformation of the sheet is prevented. Preferably, the sheet sucking force for the pallet 54 in the state of being dried is set to be smaller than the sheet sucking force for the pallet 54 during ejecting of the ink from the ink jet line heads 34. Accordingly, it is possible to prevent or suppress occurrence of unevenness of heating caused by the suction holes 54A of the pallet 54.

The pallet 54 is transported by the belt 60 of the belt driving device 58 after the holding portion 78 is removed from (is separated from) the guide hole 82 of the linear guide member 56. Then, after the sheet on the pallet 54 is separated at the sheet separating section 64, the pallet 54 is moved to return to the sheet supplying section 62 at the upstream side of the sheet transporting direction passing through the vertical-direction lower side of the linear guide member 56.

The sheet used in the above-described image forming apparatus 10 is preferably printing paper having air permeability of 1000 seconds or more and surface roughness in a range from 0.2 to 4.0 μm in terms of a centerline average roughness (Ra). The ink used herein is preferably an aqueous ink including an aqueous dispersion of colored resin fine particle in which a pigment particle is covered by a film-forming resin. A combination of the above-described sheet and ink results in improvement in the abrasion resistance and the image durability. Here, the centerline average roughness (Ra) mentioned herein refers to a value obtained by extracting a portion of the measured length L from the roughness curve in the direction of the centerline and performing arithmetic averaging (mean) of an absolute value of a deviation between the extracted centerline and the roughness curve. Further, the air permeability mentioned herein means a value that indicates sheet resistance with respect to air passing through the sheet and is represented by time for which air of 100 $cm^3$ in volume passes through the sheet having an a area of 645 $mm^2$. The measurement method of air permeability is described JIS P 8117.

Next, the operation and effect of the transporting device 52 according to the present embodiment are described.

When the sheet is transported to the sheet supplying section 62, the sheet is supplied on the pallet 54 transported by the belt 60 and is held on the pallet 54 by the chuck claw (not shown in the drawings). The pallet 54 is transported to the linear guide member 56 by circumferential movement of the belt 60 and the holding portion 78 of the pallet 54 is inserted in the guide hole 82 of the linear guide member 56. Then, the holding portion 78 of the pallet 54 moves due to magnetic force of the linear electromagnetic coil portion provided in the lower surface portion 82A of the guide hole 82, and the pallet 54 is transported on the upper surface portion 56A of the linear guide member 56. At the same time, the sheet is sucked in to the suction holes 54A of the pallet 54 due to rotation of the fans 88 provided in the linear guide member 56, and the sheet in the state of being sucked in to the pallet 54 is transported to a position that faces to the inkjet line heads 34 of four colors.

When the sheet is located at the position that faces to the inkjet line heads 34, the inks are ejected on the sheet on the pallet 54 and an image is formed on the recording surface of the sheet. At this time, the pallet 54 is transported and driven due to magnetic force of the linear electromagnetic coil portion of the linear guide member 56, therefore the transport accuracy of the sheet on the pallet 54 is improved and the precision of ink landed positions on the sheet is improved so as to realize enhancement of image quality.

Further, the transport speed of the pallet 54 by means of the linear guide member 56 is set to be slightly faster than the transport speed of the pallet 54 by means of the belt driving device 58, and therefore the transport speed of the pallet 54 can be set based on the transport speed of the pallet 54 by means of the linear guide member 56 (the linear guide member 56 can be used for rate controlling). For this reason, as compared to a case in which the pallet 54 is transported by the belt 60 during ejecting of ink by the inkjet line heads 34, enhancement of image quality can be realized.

The sheet on the pallet 54 is, after passing over the position facing to the inkjet line heads 34, transported to a position facing to the drying device 38 by the pallet 54 being moved by the linear guide member 56. Then, hot air is blown on the recording surface of the sheet from the drying device 38, so as to dry an image on the recording surface. At this time, due to the image being dried in the state of the sheet being sucked in on the pallet 54, deflection or deformation of the sheet is prevented. Further, the image is dried in a non-contact manner, therefore, occurrence of deterioration in the image quality is prevented. Further, the sucking force of the sheet onto the pallet 54 during hot-air drying using the drying device 38 is set to be smaller than that during ejecting of ink from the inkjet line heads 34, thereby making is possible to prevent or suppress occurrence of unevenness of heating on the recording surface of the sheet caused by the suction holes 54 of the pallet 54.

The sheet on the pallet 54 is, after passing over the position facing to the drying device 38, transported by the linear guide member 56 to the downstream side in the transporting direction. After the holding portion 78 departs from the guide hole 82 of the linear guide member 56, the pallet 54 is transported by the belt 60 of the belt driving device 58. Then, the sheet on the pallet 54 is transported to the sheet separating section 64 by circumferential movement of the belt 60, and the sheet on the pallet 54 is separated in the sheet separating section 64. Subsequently, the pallet 54 passes through the vertical-direction lower side of the linear guide member 56 from the sheet separating section 64 by circumferential movement of the belt 60, and is moved to return to the sheet supplying section 62 disposed at the upstream side in the sheet transporting direction.

In the above-described image forming apparatus 10, due to the pallet 54 being transported and driven along the linear guide member 56 at the position facing to the inkjet line heads 34, the transport accuracy of the sheet improves, and enhancement of image quality can be realized. Further, when the pallet 54 is moved from the sheet separating section 64 to the upstream side of the inkjet line heads 34 in the sheet transporting direction, the belt 60 is used, whereby reduction in cost can be realized as compared to a case in which entire movement of the pallet 54 is performed by the linear guide member. Moreover, when the pallet 54 is moved to return to the upstream side of the inkjet line heads 34 in the sheet transporting direction, the pallet 54 is moved through the lower side of the linear guide member 56 in the vertical direction, whereby the widthwise dimensions of the transporting device 52 and the image forming apparatus 10 are prevented from becoming larger.

Incidentally, in the above-described embodiment, a structure in which the sheet sucked in onto the pallet 54 is transported to the ink drying section 18 by the linear guide member 56 is shown, but the present invention is not limited to the same. In other words, as long as a structure in which the sheet sucked in onto the pallet 54 is transported to the position facing to the inkjet line heads 34 by the linear guide member 56 is used, the transporting section that transports the sheet to the ink drying section 18 is not limited, and for example, a structure in which the sheet held by the pallet 54 is transported by the belt 60 may also be possible.

In the above-described embodiment, ink is used as a liquid, but the present invention is not limited to the same and other liquids such as a processing liquid can also be used.

What is claimed is:

1. A transporting device comprising:

a pallet that transports a recording medium while attracting the recording medium thereto;

a first pallet transporting device as a pallet transporting section provided at a position facing a liquid ejecting head which ejects a liquid onto the recording medium, and that transports and drives the pallet by means of magnetic force along the pallet transporting section; and a second pallet transporting device, which is different from the first pallet transporting device, as a belt driving section that supports the pallet with an endless belt member, and moves the pallet from a downstream side of the liquid ejecting head in a direction in which the recording medium is transported, to an upstream side in the direction in which the recording medium is transported, via a lower side, in a vertical direction, of the pallet transporting section, wherein at the position that the pallet is facing the liquid ejecting head and at a time in which the liquid is ejected onto the recording medium on the pallet, the pallet is transported and driven by the first pallet transporting device while the pallet is supported by the second pallet transporting device.

2. The transporting device of claim 1, wherein when the pallet is transported at the position facing the liquid ejecting head, a speed at which the pallet is transported by the pallet transporting section is set to be faster than a speed at which the pallet is transported by the belt driving section.

3. The transporting device of claim 2, wherein the pallet includes suction holes that suction the recording medium to the pallet, and the pallet transporting section includes a negative pressure section that imparts suction force to the suction holes.

4. The transporting device of claim 3, wherein the pallet transporting section further includes a suction force adjusting section that adjusts negative pressure at the negative pressure section.

5. The transporting device of claim 1, wherein the pallet includes suction holes that suction the recording medium to the pallet, and the pallet transporting section includes a negative pressure section that imparts suction force to the suction holes.

6. The transporting device of claim 5, wherein the pallet transporting section further includes a suction force adjusting section that adjusts negative pressure at the negative pressure section.

7. The transporting device of claim 1, wherein a guided portion is provided at the pallet, and a guiding portion which can be inserted in the guided portion is provided at the pallet transporting section so as to extend in the recording medium transporting direction.

8. The transporting device of claim 1, wherein the pallet transporting section transports and drives the pallet by means of the magnetic force by positions of the S pole and the N pole being changed along the direction in which the recording medium is transported.

9. A liquid ejecting apparatus comprising:

a liquid ejecting head that ejects a liquid to a recording medium; and a transporting device including:

a pallet that transports a recording medium while attracting the recording medium thereto;

a first pallet transporting device as a pallet transporting section provided at a position facing a liquid ejecting head which ejects a liquid onto the recording medium, and that transports and drives the pallet by means of magnetic force along the pallet transporting section; and a second pallet transporting device, which is different from the first pallet transporting device, as a belt driving section that supports the pallet with a belt member, and moves the pallet from a downstream side of the liquid ejecting head in a direction in which the recording medium is transported, to an upstream side in the direction in which the recording medium is transported, via a lower side, in a vertical direction, of the pallet transporting section, wherein an image is formed by the recording medium attracted to the pallet being passed through the position facing the liquid ejecting head, and at the position that the pallet is facing the liquid ejecting head and at a time in which the liquid is ejected onto the recording medium on the pallet, the pallet is transported and driven by the first pallet transporting device while the pallet is supported by the second pallet transporting device.

10. The liquid ejecting apparatus of claim 9, further comprising:

a drying section provided at the downstream side of the liquid ejecting head in the recording medium transporting direction, that dries an image surface at which the liquid is ejected to the recording medium without contact the recording medium; and a heating and fixing section provided at a downstream side of the drying section in the recording medium transporting direction, that fixes the image surface of the recording medium by applying heat thereto.

11. The liquid ejecting apparatus of claim 10, wherein the pallet transporting section is provided at a position facing the liquid ejecting head and the drying section.

12. The liquid ejecting apparatus of claim 9, wherein the recording medium is a print paper having air permeability of not less than 1000 seconds and a surface roughness in the range of 0.2 to 4.0 μm in terms of a centerline average roughness (Ra), and the liquid is an aqueous ink including an aqueous dispersion of a colored resin fine particle in which a pigment particle is covered by a film-forming resin.

13. The liquid ejecting apparatus of claim 9, wherein when the pallet is transported at the position facing the liquid ejecting head, a speed at which the pallet is transported by the pallet transporting section is set to be faster than a speed at which the pallet is transported by the belt driving section.

14. The liquid ejecting apparatus of claim 9, wherein the pallet transporting section transports and drives the pallet by means of the magnetic force by positions of the S pole and the N pole being changed along the direction in which the recording medium is transported.

* * * * *